United States Patent [19]

Baker

[11] Patent Number: 4,790,416

[45] Date of Patent: Dec. 13, 1988

[54] DESK CONVERTING CARRYING CASE

[75] Inventor: Franklin W. Baker, Los Angeles, Calif.

[73] Assignees: William M. Kitner, Rolling Hills Estates; Martha T. Cota, Granada Hills, both of Calif. ; part interest to each

[21] Appl. No.: 942,454

[22] PCT Filed: Aug. 1, 1985

[86] PCT No.: PCT/US85/01449

§ 371 Date: Dec. 8, 1986

§ 102(e) Date: Dec. 8, 1986

[87] PCT Pub. No.: WO87/00737

PCT Pub. Date: Feb. 12, 1987

[51] Int. Cl.[4] ..... A47B 3/10

[52] U.S. Cl. ..... 190/11; 108/159; 248/164; 248/188; 248/188.5; 312/244

[58] Field of Search ..... 190/1, 10, 11, 12 R, 190/12 A; 248/188, 188.5, 164; 108/14, 34, 159; 312/244

[56] References Cited

U.S. PATENT DOCUMENTS

| | | | |
|---|---|---|---|
| 78,259 | 5/1868 | Cameron | 108/34 |
| 307,188 | 10/1884 | Ganick | 190/11 |
| 743,938 | 11/1903 | Sharkey | 108/34 |
| 873,855 | 12/1907 | Goldin | 190/18 R |
| 908,487 | 1/1909 | Nail | 190/11 |
| 1,135,864 | 4/1915 | Tomassi | 108/34 |
| 1,533,494 | 4/1925 | Billburg | 190/12 R |
| 2,217,914 | 10/1940 | McMahan | 248/188 |
| 2,291,748 | 8/1942 | Neuwirth | 248/188.5 |
| 2,431,711 | 12/1947 | Scott | 190/11 X |
| 2,455,525 | 12/1948 | Schulz | 403/104 X |
| 2,522,322 | 9/1950 | Wallace | 190/11 |
| 2,716,582 | 8/1955 | Rosenfeld | 108/159 X |
| 2,719,688 | 10/1955 | Seifert | 248/188.5 |
| 2,922,026 | 7/1961 | Farber | 248/188.5 X |
| 3,049,825 | 8/1962 | Boyd | 190/11 X |
| 3,082,049 | 3/1963 | Lifton | 190/11 X |
| 3,103,375 | 9/1963 | McMullin | 403/300 |
| 3,106,296 | 10/1963 | Walsh et al. | 108/159 X |
| 3,315,621 | 4/1967 | Szymber | 108/34 |
| 4,011,821 | 3/1977 | Neal | 248/188 |
| 4,079,978 | 3/1978 | McMullin | 248/188.5 X |

FOREIGN PATENT DOCUMENTS

| | | | |
|---|---|---|---|
| 2347965 | 4/1975 | Fed. Rep. of Germany | 190/11 |
| 9090 | of 1908 | United Kingdom | 190/38 |

*Primary Examiner*—William Price
*Assistant Examiner*—Sue A. Weaver
*Attorney, Agent, or Firm*—Albert O. Cota

[57] ABSTRACT

A rigid carrying case (20) having a handle and a hinge in the center, is combined with a removable flat top (22) that is attached when opened forming a portable table. Legs (52) are stored within housings (32) located inside of the case (20) and are released by depressing an actuator (64) protruding outside of the case perimeter. The legs (52) cross each other thereby holding them rigidly in place with assistance of a non-slipping resilient bumper (60) on the end of each leg. The housing (32) is attached inside the case (20) with a housing cap (36) on one end and restraining means on the other consisting of a locknut (44), spacer (46), locknut with a lip (48), and an "O" ring (50). A second embodiment adds a separable leg extension (80), and a third embodiment adds length to the legs (52) utilizing a second telescoping leg (82).

20 Claims, 3 Drawing Sheets

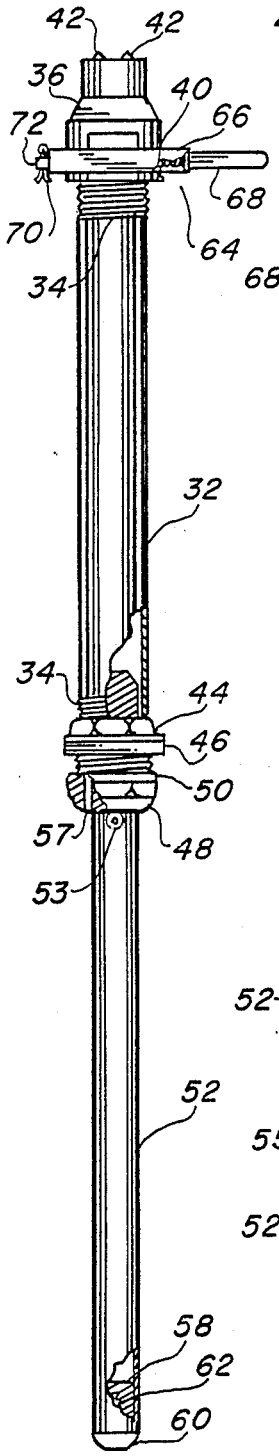
FIG. 6
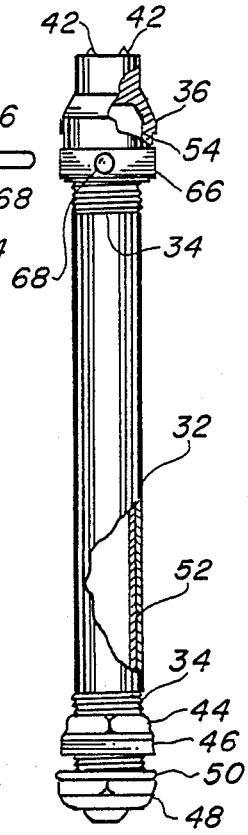
FIG. 7
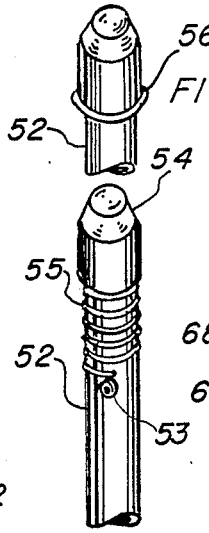
FIG. 18
FIG. 8
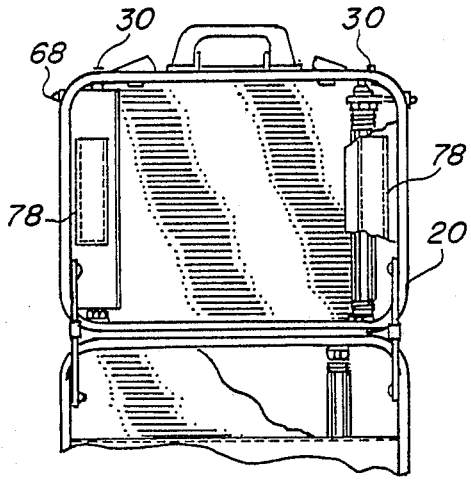
FIG. 9
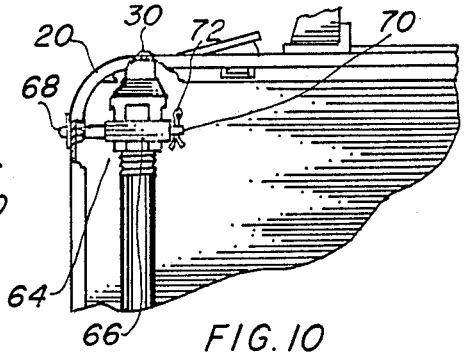
FIG. 10
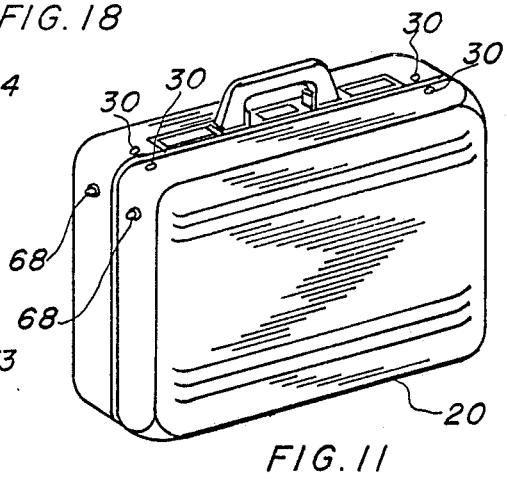
FIG. 11

42
36
13
42
66
68
34
13
32
88'
44
34
34
46
48
50
86
53
52
80
60
72
64
70
74
68
66

42
42
88
88'
56'
66
56
40
38
70
74
90'
32
90
52
82

75
48'
76

22
24
24
20
52
52
80
80
60
60

82
84
60

DESK CONVERTING CARRYING CASE

TECHNICAL FIELD

The invention pertains to the general field of hand carried utility cases and more particularly to a brief case incorporating a set of telescoping legs that allow the case to be propped upright in an open position and a table placed across its two top sections.

BACKGROUND ART

Conventional hand carried cases such as briefcases, rigid camera cases and other utility cases are designed primarily to allow equipment, papers, etc. to be stored and carried. Attempts have been made to add additional utility to these cases by incorporating foldable legs and tops. However, in most cases, the additional implements required to increase the utility are cumbersome, reduce the carrying capacity and are not authentically designed.

A search of the prior art did not disclose any patents that read directly on the claims of the instant invention, however, the following U.S. patents were considered related:

| Patent Number | Inventor | Date Issued |
|---|---|---|
| 4,412,604 | Bell, et al | Nov. 1, 1983 |
| 4,034,518 | Trecker | July 12, 1977 |
| 2,522,322 | Wallace | Sept. 12, 1950 |
| 1,211,829 | Eades | Jan. 9, 1917 |
| 873,855 | Goldin | Dec. 17, 1907 |
| | Bundesrepbublik Deutschland | |
| 815,225 | Peter Reimitz, Wetzlar/Lahn | Oct. 1, 1951 |

Bell teaches a combination luggage case and stand with an extension. The case has an openable top with a hinged cover and foldable legs. This folding structure includes a fork shaped support used as a table, and a second position raising the nose to be horizontal, forming an extension table.

Trecker discloses a portable cot and table that folds into a carrying case. Extensions are added to lengthen the structure, and hhe legs are added to the center bottom of the structure. The corner legs are hinged and swing into the case when not in use. All six legs are extensible to raise the height of the flat horizontal surface to enable the unit to be used as a table.

Wallace utilizes a biforcated leg structure optionally supporting luggage sections in a horizontal position. The legs are removable and longitudinally adjusted by nesting together with sockets extending into the container without being in communication with the interior thereof. The legs may be used in triplicate in one of the two alternate positions, serving as a flat topped table with the container closed. A fourth leg is added when the container is opened flat.

Eades employs four supporting legs to impart the requisite sustenance to a suitcase to be converted into a table. The legs are hinged from beneath and embody two telescoping connecting sections, the upper being hollow having threaded therethrough a clamping screw coacting with a second section which provides the predetermined relative adjustment. The case is characterized by three pivotally connected units adapted to be folded into superimposed relation.

Goldin practices a dressing case, or valise, convertable to form a table to be used in railway compartments, and the like. The case is provided with four collapsible legs formed of lengths of tube made to slide one within the other, the inner one being provided with a slot, or groove, in which a stud, or pin, slides. The lower end of the slot being formed into a helical shape permitting the legs to be twisted reducing the width of the gap while increasing the friction, allowing the leg to stand by itself. The legs are stored withnn the case when telescoped together with only silver plated disks visible from the exterior, shaped so as to facilitate easy withdrawal and fixing.

The German patent issued to Reimitz teaches a briefcase, with crossed telescoping legs that are held in place by a detent pin when extended into a hole in the leg. The legs are in "U" shape and pivotally attached with separable brackets. In order for the detent pins to lineup with the hole in the "U" shaped leg, a groove is placed in the extended leg and corresponds with an operative on the bracket.

DISCLOSURE OF THE INVENTION

When people travel, the convenience of having a surface, such as a table, may not always be available. In particular, when waiting at an airport or train station, time may be available for the businessman to utilize the opportunity to great advantage if there were such a surface available. Further, conditions arise where one may be seated, such as in a lobby, or anywhere one is waiting, where tables may be available, but not located conveniently. Therefore, the primary object of the invention allows conversion of a conventional briefcase, in which papers and documents are normally carried, into a convenient elevated, open upright position on which a table suitable for writing, calculating, or the like may be fastened. The table allows the user to have available all of the pertinent information without opening the briefcase again by simply reaching inside. Further, storage is easy with such an arrangement, and since the top is covered, confidential material is not easily viewed by those casually passing by. The table may be of a one piece construction or may have a hinge that allows the table to be folded and placed inside the briefcase when not in use.

Another object of the invention deals with the unobtrusiveness of the briefcase modification. The only evidence available from the outside are snap fasteners located on the top, release buttons on the sides, and leg end bumpers on the bottom that appear to be the usual resilient briefcase hardware. The fasteners on the top are relatively small and do not extend greatly from the surface, while the leg release mechanism on the side is characterized by a round flange with a radial button therein, both components plated or finished in like manner to that of the existing case hardware. To the unknowing, the briefcase would not appear unusual during its normal carrying utility.

Still another object of the invention provides a lightweight addition to the case. This modification requires only a writing table top and four legs to provide the additional utility. In all cases these components are designed using lightweight material, such as aluminum and composition board, well known for their strength to weight ratio.

The ease of operation is yet another object of the invention, as the operator is to simply push the leg release buttons located on the side of the case and the legs extend by gravity. The case is then opened in the normal manner with the top placed on the open edges an secured with snap fasteners well known in the art. The crossed position of the legs eliminates the need for further securement with the device ready for operation using these simple procedures. As no particular direction is required, the procedure becomes obvious to the user immediately.

These and other objects and advantages of the present invention will become apparent from the subsequent detailed description of the preferred embodiment and the appended claims taken in conjunction with the accompanying drawings.

BRIEF DESCRIPTION OF THE DRAWINGS

FIG. 6 is a side view of the distended leg assembly completely removed from the invention for clarity.

FIG. 7 is a side view of the retracted leg assembly completely removed from the invention for clarity.

FIG. 8 is a partial end view of the telescoping leg completely removed from the assembly for clarity.

FIG. 9 is a partial plan view of the opened briefcase illustrating the interior with the pencil holder and compartment flap partially cut-away.

FIG. 10 is a partial view of the opened briefcase with the flange cut-away to illustrate the leg release actuator.

FIG. 11 is a partial isometric view of the preferred embodiment in its closed, ready to carry position.

FIG. 18 is a partial end view of the telescoping leg in the preferred embodiment completely removed from the assembly for clarity.

BEST MODE FOR CARRYING OUT THE INVENTION

The best mode for carrying out the invention is presented in the terms of a preferred, second, and third embodiment. All three embodiment are primarily designed to provide a portable table with a writing surface in conjunction with a briefcase. The preferred embodiment is pictorially illustrated in FIGS. 1–12, and consists of a rigid carrying case 20, commonly designated as a briefcase. This case 20 includes a carrying handle and a clam shell hinge, opening in the center with locking hardware, and a pair of articulated opening stops. The case 20 may be made of any material, such as aluminum, leather, or vinyl, with a cardboard or composition board secondary structure. No special construction is required as long as the case 20 is rigid and the corners are relatively square.

Figure 1:
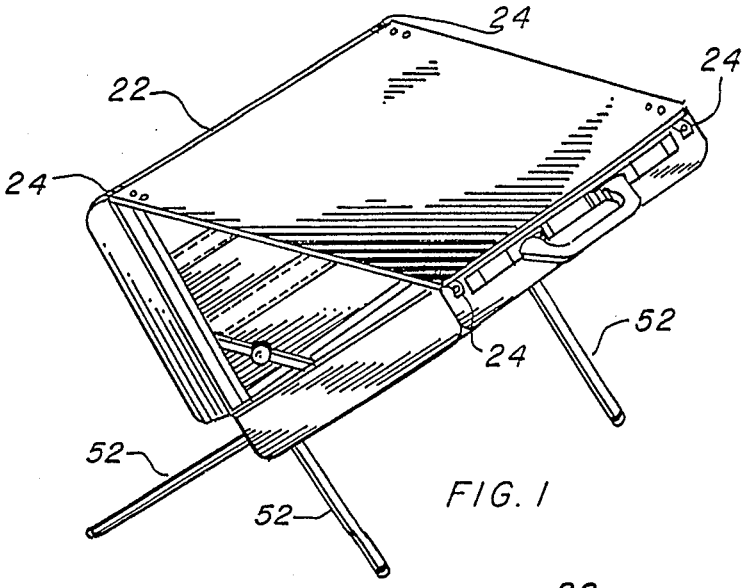
FIG. 1 is a partial isometric view of the preferred embodiment with the briefcase opened, top assembled and legs extended, ready for use.
Figure 2:
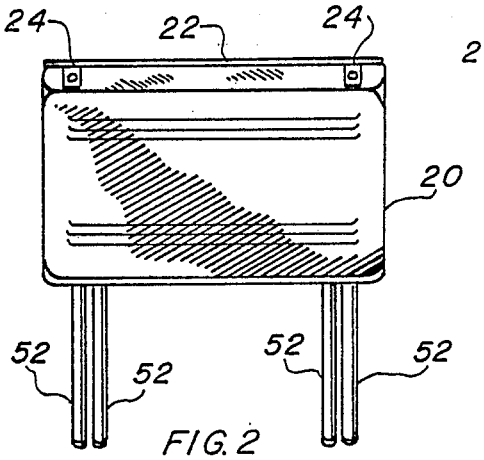
FIG. 2 is a side elevational view of the preferred embodiment, as above.
Figure 3:
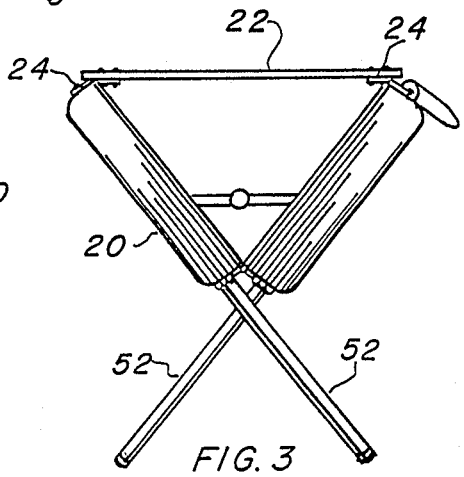
FIG. 3 is an end view of the preferred embodiment, as above.
Figure 4:
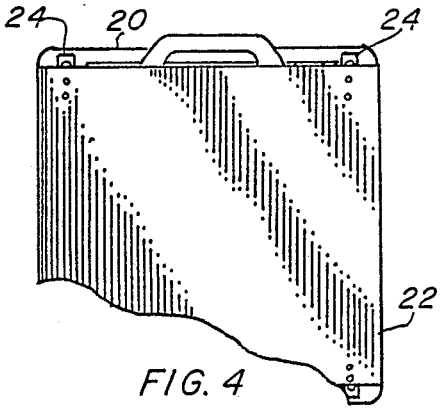
FIG. 4 is a top view of the preferred embodiment partially cut-away.
Figure 5:
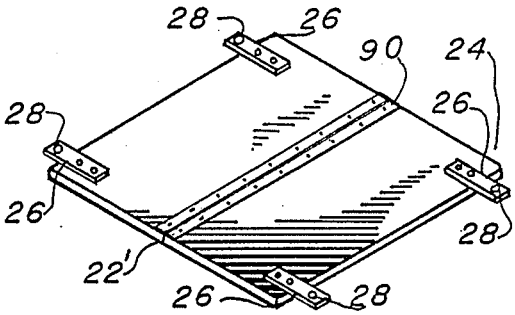
FIG. 5 is a partial isometric view of the table top turned upside down to show the mounting structure and hinge on the bottom.

A removable table top 22 is utilized that has a flat surface on the upper side, and is sized to be attached to the opened edges of the case 20. The top 22 is composed of a rigid substance, such as composition board, aluminum, or the like, and at least two edges of the case are in contact when installed on the briefcase providing a planar working surface. The top 22 is connected to the opened case with fastening means 24 providing a secure attachment in a removable manner. This fastening means 24 preferably consists of a plurality of resilient tabs 26 positioned on the underside of the top 22 at each corner with male snap fasteners 28 secured thereupon. The tabs 26 are, in turn, attached to the top 22 with rivets, adhesive, or the like. A plurality of mating female snap fasteners 30 are fixed to the case 20 at the appropriate location interlocking together forming a removable joint when so attached. The table 22' may be constructed in one piece or may have a hinge 90, as shown in FIG. 5, that allows the table to be folded and placed inside the briefcase when not in use.

A plurality of leg retaining housings 32 are installed within the case 20 at each outside corner, providing a storage enclosure and structured guide for the legs. The housings 32 are hollow and cylindrical in shape, in pipe fashion, wihh external threads 34 on each end.

A housing retaining cap 36 is threadably positioned on the upper end of each housing 32 and contains an aligned bore 38 and a spring retaining cavity 40 on opposed sides. This cap may further contain sharp projections 42 distended from the outermost surface, which is contiguous with the inside surface of the case 20 providing restraining means and interface therewith by penetrating the case lining.

In another embodiment, not shown, the housing retaining cap 36 may be deleted. In this design a resilient cap or a hard cap with sharp projections is inserted over the top of the housing 32 which then makes contact with the inside surface of the case 20.

Each housing 32 contains a telescoping leg 52 that is slideably positioned within. This leg 52 is in tubular shape and is slightly smaller in diameter than the inside of the housing 32 allowing a free slip fit therebetween. The leg 52, as well as the housing 32, is made of a structurally sound material, such as metal, or thermoplastic, with aluminum of a hard, heat-treated temper being preferred.

Leg retaining means are disposed integrally with each leg 52 limiting the extension of travel when the leg 52 is advanced from the housing 32. This is accomplished by the use of a male tapered end plug 54 and a plug "0" ring 56 on the end of each leg 52 shown in FIG. 18. This configuration prevents removal of the leg 52 from the housing 3 by creating a mechanical interference when the leg 52 is extended almost entirely from the housing 32 by contact with the lip of the locknut 48 in a rigid manner.

On the opposite end of the housing 32 restraining means are included in the form of an internally threaded locknut 44 and spacer 46 positioned within the case 20 on one side, and an internally threaded locknut with a lip 48 and a resilient "0" ring 50 on the other outside of the case acting as a washer to prevent marring of the case. This restraining means connects the leg retaining housing 32 to the case 20 on the end opposite the retaining cap 36 and joins the housing 32 permanently thereunto by urging the cap 36 onto the inside surface of the case 20 in a compressible manner. This restraint is initially adjusted by relying upon the external threads 34 of the housing 32 for movable positioning.

The leg 52 may retain itself by the cross position it assumes when the case 20 is opened using the "O" ring 56 as a stop, shown in FIG. 18, or an alternate method shown in FIGS. 6 and 8 incorporates the use of a rough retaining button 53 with a flat head attached to the leg 52 and a compression spring 55 retained between the button 53 and the plug 54, best illustrated in FIG. 8. A slot 57 shown in FIG. 6 is located in the locknut 48 that receives the button 53 allowing it to pass freely therethrough when in alignment. In operation the leg 52 is extended and the user pulls the leg outwardly with the button 53 passing through the slot 57 against the tension of the spring 55 between the plug 54 and the locknut 48 and rotates the leg until the button 53 is out of alignment holding it compressably in place. Retraction is accomplished in an opposite manner.

Resilient end means are fixed to the extended ends of the legs 52 to provide an elastic surface on which the case may rest. This end is comprised of a male threaded sleeve 58 screwed into the female open end of the leg 52 with a resilient bumper 60 connected by a fastener, such as a screw 62. The bumper 60 is the same approximate diameter as the leg 52 and is formed of synthetic rubber, or soft thermoplastic material.

A leg release actuator 64 is slideably positioned over the cap 36 and mechanically restricts the movement of the leg 52 when retracted and allows release by external actuation from outside of the case even before opening. This actuator 64 consists of a rectangular keeper 66 having a narrow end slightly larger on the inside than the outside of the retaining cap 36. The function of the keeper 66 is to transmit the manual actuation from the outside to the inside of the cap. A manual plunger 68 is attached to one of the narrow sides of the keeper 66 and depends outwardly with a release pin 70 similarly attached on the other, except it extends on both sides.

The release pin 70 contains a stepped shoulder with a hole therethrough with the small end protruding outwardly, and the large end oo the inside. Pin retaining means 72, in the form of a cotter pin, holds the pin 70 into the keeper 66. A compression spring 74 completes the assembly and is disposed between the narrow side of the keeper 66, opposite the pin 70, and nests into the spring retaining cavity 40 of the cap 36. The assembly is pictorially illustrated slideably fixed to the cap 36 in FIG. 6 and is depicted removed and singly in FIG. 12. A flanged bushing 75 and lockring 76 are connected through the side wall of the case 20, and are in alignment with the leg release actuator 64. The manual plunger 68 penetrates through the bushing 75 and extends to the outside of the suitcase 20. The plunger 68 is contained and spring loaded to hold the pin 70 against the plug "0" ring 56, keeping the leg 52 in the retracted position.

In operation the case 20 is held in the vertical position and each plunger 68 is depressed one at a time. This slowly distends the eegs 52 to their maximum extension where they are held in place by the lip of the locknut 48, engaging the "0" ring 56. The case 20 is then opened in a normal manner and placed on the floor. The position of the crossed legs 52 held by the bumper 60 on the end steadies the case 20 and provides sufficient strength to be held in the upright position. The table top 22 is then removed from the case interior and snapped onto the upper surfaces of the case 20. Stowage is obtained by the reverse procedure.

A pair of writing implement holders 78, serving to hold pens and pencils, as well as covering the housings 32, are attached on the inside of the case. The holders 78 contain an open ended pocket, and the body is a resilient member stretching between the sides and ends to form a taut cover.

Figures 12, 13, 14, 15, 16, 17:
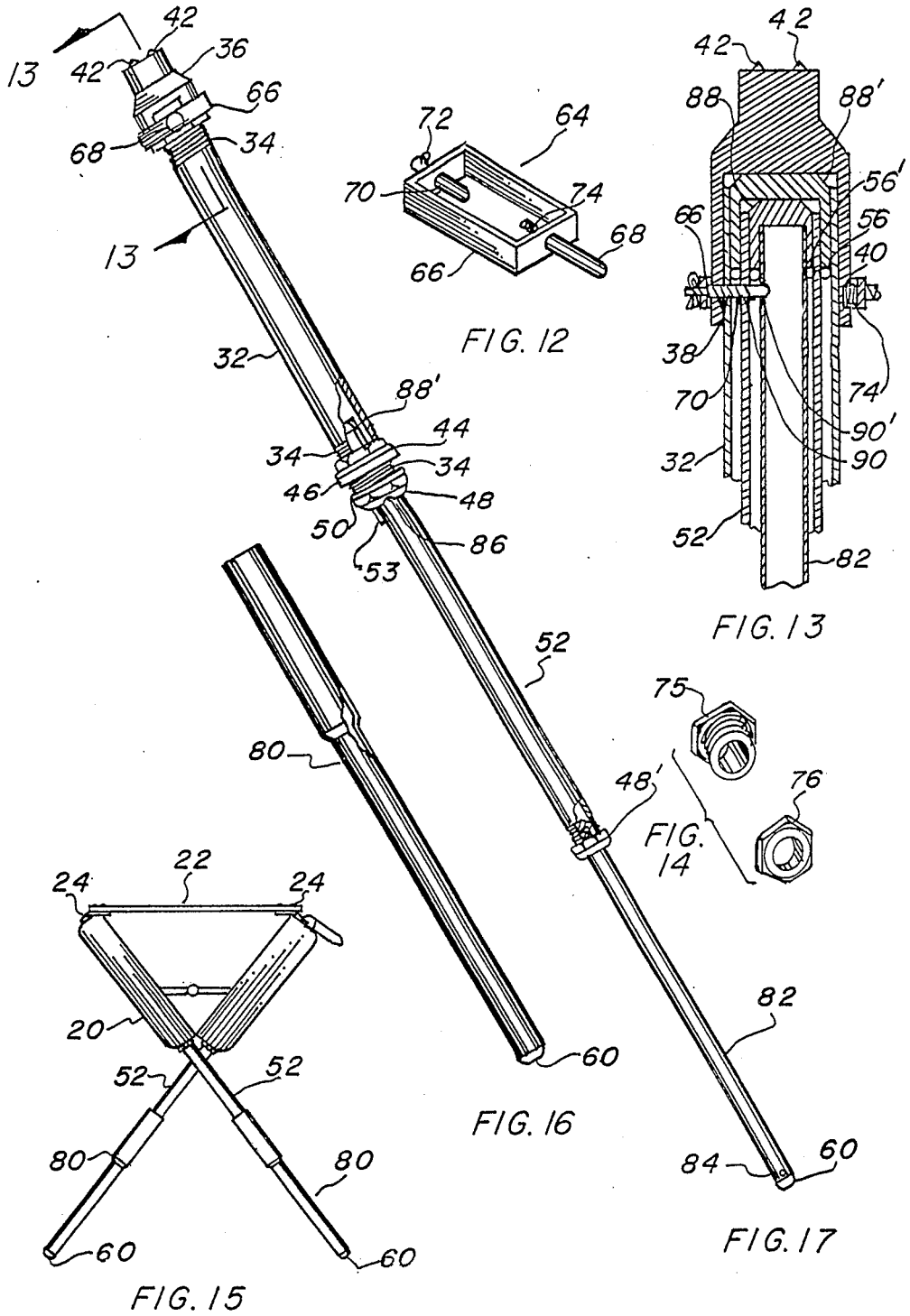
FIG. 12 is a partial isometric view of the leg release actuator consisting of the keeper plunger, pin, and spring completely removed from the invention for clarity.
FIG. 13 is a cross-sectional view of the third embodiment taken along lines 13—13 of FIG. 17, however, with the legs in the retracted position.
FIG. 14 is an exploded isometric view of the flanged bushing and locknut of the leg release mechanism.
FIG. 15 is a side view of the second embodiment with the leg extensions in place.
FIG. 16 is a side view of the leg extension of the second embodiment completely removed from the invention.
FIG. 17 is a side view of the third embodiment with the leg distended completely removed from the invention for clarity, similar to FIG. 6, but rotated 90°.

The second embodiment, illustrated in FIGS. 15 and 16, is comprised of the same elements as previously described, except a removable leg extension 80 is positioned over each telescoping leg 52. These extensions 80 have one end slightly larger in the inside diameter than the outside diameter of the leg 52, and the other end the same size as the basic leg. This allows a slip fit therebetween and elevates the invention to a convenient height to write upon when seated. The extensions 80 are stored inside the case 20 when not in use.

The third embodiment is illustrated in FIGS. 13 and 17, again including all of the elements thus described. The only difference is the addition of another telescoping leg and indexing to allow the release actuator to hold the leg in place. The second telescoping leg 82 is identical with the first, except the addition of an indexing projection 84 near the extended end. The locknut 48' is also slightly different in that it contains a recess 86 in the bottom surface. Finally, the male tapered end plug 54 is replaced by female plug 88 and 88' one on each end, shown in FIG. 13, that allows both telescoping legs 52 and 82 to nest completely within. In operation the legs are distended, as before, and the set-up is identical. To retract the legs, the second leg 82 telescopes into the first leg 52, and when the first leg 52 fully enters the housing 32, the projection on the second leg 84 nests into the recess 86 in the locknut 48. This alignment allows the release pin 70 to enter through a hole 90 in the first leg 52 and 90' one on each leg to mate with the "O" ring 56 and 56' on the female plug 88 and 88'. The balance of the operation and utility remain the same. The extension of the leg 52 and 82 are limited by engaging the "O" ring 56 and 56' against the lip of the locknut 48 and 48' respectively, as shown in FIG. 17.

I claim:

1. A desk converting carrying case comprising:

(a) a rigid carrying case with a handle, a lining, and a clam shell hinge to open in the center, (b) a plurality of leg retaining housings, having external threads thereupon positioned within said case on each outside corner providing a storage enclosure and structured guide;

(c) a plurality of housing retaining caps having an aligned bore and a spring retaining cavity on opposed sides, said cap threadably fastened on one end of each leg retaining housing, each cap contiguous with the inside surface of said case and including confining means for interface with said case;

(d) restraining means between said leg retaining housing and said rigid case on the end opposite said retaining cap for joining said housing permanently thereunto by urging said cap onto the inside surface of the case in a compresssible manner;

(e) a plurality of telescoping legs, one slidably disposed with each housing providing an extended member when advanced therefrom;

(f) leg retaining means disposed integrally with each leg limiting the extension of travel when said leg is advanced from said retaining housing by structural interference;

(g) resilient end means fixed to the extended end of each leg providing an elastic surface on which said case resides in the opened desk converted condition; and, (h) a leg release actuator means on each leg mechanically restricting the movement of said leg within said housing in the retracted position by an interference thereunto, with manual release actuation externally from said case allowing the legs to be extended from outside before opening the case.

2. The invention as recited in claim 1 wherein said confining means of said housing retaining cap comprises a plurality of sharp projections distended from the surface contiguous from said case providing a non-slip interface therebetween by penetrating said case lining.

3. The invention as recited in claim 1 wherein said restraining means further comprises an internally threaded locknut and spacer postioned threadably within the case on one side and an internally threaded locknut with a lip somewhat smaller than the internal diameter of said housing along with an "0" ring on the other disposed on the outside of said case providing an adjustable restraint relying upon said housing external threads for movable positioning thereof.

4. The invention as recited in claim 1 wherein said leg retaining means further comprises a male tapered end plug with a resilient "0" ring disposed within the end of each telescoping leg preventing removal of said leg from said retaining housing by creating mechanical interference with said restraining means where the leg is extended almost entirely from said housing.

5. The invention as recited in claim 1 wherein said resilient end means further comprises a threaded sleeve, a threaded fastener, and a resilient bumper, said sleeve is screwed into an opening in the extended end of each telescoping leg and said bumper is attached to the sleeve with the threaded fastener.

6. The invention as recited in claim 1 wherein said leg release actuator means further comprises:

(a) a rectangular keeper having a first and second narrow end slightly larger on the inside than the outside of said retaining cap for moving from one side of the cap to the other;

(b) a manual plunger attached to the first side of said keeper depending outwardly therefrom for movement of the actuator;

(c) a release pin having a stepped shoulder and a hole therethrough the pin penetrating said second side of said keeper and said telescoping leg on one end and the bore in said cap on the other for inhibiting movement of said leg when contiguous thereunto;

(d) pin retaining means for holding said pin into said keeper;

(e) a compression spring contiguous with the first side of said keeper and disposed within said cap spring retaining cavity for urging said pin into interference with said telescoping leg holding it into retracted position; and, (f) a flanged bushing and lock ring connected in concert through said carrying case in alignment with said manual plunger providing slidable engagement holding said actuator in place upon said retaining cap resulting in release of said leg when manually depressing the pluger and containment when urged by said spring.

7. The invention as recited in claim 1 further comprising a pluarlity of writing implement holders characterized by an open ended pocket attached to a resilient member, said member affixed to the inside of said case, also acting as a cover for said housing, as well as a retainer for ancillary elements in normal use with said carrying case.

8. The invention as recited in claim 1 further comprising a plurality of removable leg extensions, one positioned over each telescoping leg, having one end slightly larger in inside diameter than said leg and the other end the same outside diameter as the leg for extending said legs placing said carrying case at a convenient height for writing thereupon.

9. The invention as recited in claim 1 wherein said leg retaining means comprises a retaining button attached to said leg, a compression spring around said leg above said button for retaining the leg in the extended position by manually compressing said spring when the button is rotated on the outside of said housing.

10. A desk converting carrying case as recited in claim 1 further comprising:

(a) a removable table top having a flat surface on the upper side positioned upon said opened case with at least two edges continguous thereunto, providing a planar working surface; and (b) fastening means connecting said top to said case in a removable manner providing a secure attachement therefore.

11. A desk converting carrying case comprising:

(a) a rigid carrying case with a handle, a lining, and a clam shell hinge to open in the center;

(b) a removable table top having a flat surface on the upper side positioned upon said opened case with at least two edges contiguous thereunto, providing a planar work surface;

(c) fastening means connecting said top to said case in a removable manner providing a secure attachment therefore;

(d) a plurality of leg retaining housings, having external threads on each end, positioned within said case on each outside corner providing a storage enclosure and structured guide;

(e) a plurality of housing retaining caps having an aligned bore and a spring retaining cavity on opposed sides, said cap threadably fastened on one end of each leg retaining housing, each cap contiguous with the inside surface of said case and including confining means for interface with said case;

(f) restraining means between said leg retaining housing and said rigid case on the end opposite said retaining cap for joining said housing permanently thereunto by urging said cap onto the inside surface of the case in a compressible manner;

(g) a pair of telescoping legs, having an innermost and outermost leg with said outermost leg having a top and bottom end with an indexing projection near the bottom end, slidably disposed in tandum within each housing providing an extended combined member when advanced therefrom;

(h) female leg retaining means disposed integrally with each leg limiting the extension of travel when said leg is advanced from said retaining housing by structural interfenence;

(i) resilient end means fixed to the extended end of the outermost leg providing an elastic surface on which said case resides in the opened desk converted condition; and, (j) a leg release actuator means on each leg manually restricting the movement of said leg within said housing in the retracted position by a mechanical interference thereunto with manual release actuation externally from said case allowing the legs to be extended from outside before opening.

12. The invention as recited in claim 11 wherein said fastening means connecting said top to said case further comprises a plurality of resilient tabs on the underside of said top at each corner having male snap fasteners therein, and a plurality of mating female snap fasteners disposed upon contiguous surfaces of said case interlocking together forming a removable union thereunto.

13. The invention as recited in claim 11 wherein said confining means of said housing retaining cap comprises a plurality of sharp projections distended from the surface contiguous from said case providing a non-slip interface therebetween by penetrating the lining of said case.

14. The invention as recited in claim 11 wherein said restraining means further comprises an internally threaded locknut and spacer positioned threadably within the case on one side and an internally threaded locknut with a lip somewhat smaller than the internal diameter of said housing with a recess on the bottom surface, along with an "0" ring on the other disposed on the outside of said case providing an adjusted restraint relying upon said housing external threads for movable posiioning thereof.

15. The invention as recited in claim 11 wherein said leg retaining means further comprises a female tapered end plug with a resilient "0" ring disposed within the end of each telescoping leg preventing removal of said leg from said retaining housing by creating mechanical interference with said restraining means where the leg is extended almost entirely from said housing.

16. The invention as recited in claim 11 wherein said resilient end means further comprise a threaded sleeve, a threaded fastener, and a resilient bumper, said sleeve is screwed into an opening in the extended end of each telescoping leg and said bumper is attached to the sleeve with the threaded fastener.

17. The invention as recited in claim 11 wherein said leg release actuator means further comprises (a) a rectangular keeper having a first and second narrow end slightly larger on the inside than the outside of said retaining cap for moving from one side of the cap to the other;

(b) a manual plunger attached to the first side of said keeper depending outwardly therefrom for movement of the actuator;

(c) a release pin having a stepped shoulder and a hole therethrough the pin penetrating said second side of said keeper on one end and the bore in said cap on the other for inhibiting movement of said leg when contiguous thereunto;

(d) pin retaining means for holding said pin into said keeper;

(e) a compression spring contiguous with the first side of said keeper and disposed within said cap spring retaining cavity for urging said pin into interference with said telescoping leg holding it into retracted position; and, (f) a flanged bushing and lock ring connected in concert through said carrying case in alignment with said manual plunger providing slidable engagement holding said actuator in place upon said retaining cap resulting in release of said leg when manually depressing the plunger and containment when urged by said spring.

18. The invention as recited in claim 11 further comprising a plurality of writing implement holders characterized by an open ended pocket attached to a resilient member, said member affixed to the inside of said case, also acting as a cover for said housing, as well as a retainer for ancillary elements in normal use with said carrying case.

19. The invention as recited in claim 11 further comprising, a removable leg extension manually positioned over the telescoping leg, having one end slightly larger in inside diameter than said leg, and the other end the same outside diameter as the leg for extending said leg, placing said carrying case at a convenient height for writing thereupon.

20. The invention as recited in claim 11 further comprising a hinge extending along the inside center of said table top such that when said table is folded it can be stored inside said carrying case.

* * * * *